US008950505B2

(12) United States Patent
Themig et al.

(10) Patent No.: US 8,950,505 B2
(45) Date of Patent: Feb. 10, 2015

(54) METHOD AND APPARATUS FOR SETTING A WELLBORE PACKER

(75) Inventors: Daniel Jon Themig, Calgary (CA); Robert Joe Coon, Missouri City, TX (US)

(73) Assignee: Packers Plus Energy Services Inc., Calgary (CA)

( * ) Notice: Subject to any disclaimer, the term of this patent is extended or adjusted under 35 U.S.C. 154(b) by 0 days.

(21) Appl. No.: 13/877,988

(22) PCT Filed: Nov. 23, 2011

(86) PCT No.: PCT/CA2011/001286

§ 371 (c)(1), (2), (4) Date: Apr. 5, 2013

(87) PCT Pub. No.: WO2012/068672

PCT Pub. Date: May 31, 2012

(65) Prior Publication Data

US 2013/0233574 A1 Sep. 12, 2013

Related U.S. Application Data

(60) Provisional application No. 61/416,697, filed on Nov. 23, 2010, provisional application No. 61/417,253, filed on Nov. 25, 2010.

(51) Int. Cl.

| | |
|---|---|
| ***E21B 33/12*** | (2006.01) |
| ***E21B 23/06*** | (2006.01) |
| ***E21B 33/128*** | (2006.01) |

(52) U.S. Cl.

CPC ..... *E21B 23/06* (2013.01); *E21B 33/1285* (2013.01)

USPC ..... 166/387; 166/120; 166/179

(58) Field of Classification Search

CPC ... E21B 33/1285; E21B 33/128; E21B 23/06; E21B 33/12; E21B 33/34; E21B 33/122

USPC ..... 166/387, 120, 179

See application file for complete search history.

(56) References Cited

U.S. PATENT DOCUMENTS

| | | | | |
|---|---|---|---|---|
| 3,233,674 | A | | 2/1966 | Leutwyler |
| 3,603,392 | A | * | 9/1971 | McGill ..... 166/216 |
| 3,716,101 | A | | 2/1973 | McGowen, Jr. et al. |
| 4,896,722 | A | | 1/1990 | Upchurch |
| 5,146,983 | A | | 9/1992 | Hromas et al. |
| 5,810,082 | A | | 9/1998 | Jordan, Jr. |
| 2002/0195253 | A1 | | 12/2002 | Hill, Jr. et al. |

FOREIGN PATENT DOCUMENTS

| | | |
|---|---|---|
| GB | 2345505 | 7/2000 |
| GB | 2385364 | 8/2003 |

* cited by examiner

*Primary Examiner* — Yong-Suk (Philip) Ro

(74) *Attorney, Agent, or Firm* — Bennett Jones LLP

(57) ABSTRACT

A wellbore packer for setting one or more packing elements in a borehole having an open hole section. The wellbore packer comprises a port-less mandrel configured with one or more packing elements and one or more setting mechanisms. The setting mechanism is responsive to a to a driving force and configured to set the packing elements in the borehole, wherein the driving force is not tubing string pressure.

5 Claims, 2 Drawing Sheets

METHOD AND APPARATUS FOR SETTING A WELLBORE PACKER

FIELD OF THE INVENTION

The invention relates to a tool for wellbore operations and, in particular, a packer for control of wellbore fluid migration.

BACKGROUND OF THE INVENTION

In wellbore operations, packers may be used to control migration of fluids outside a liner installed in the wellbore. For example, packers may be installed in the annulus between the liner and the wellbore wall to deter migration of the fluids axially along the annulus.

Packers may be set by hydraulics. Oftentimes, the hydraulic pressure is introduced through the tubular string on which the packer is installed and is communicated to the packer's hydraulically actuated system by a port through the tubular wall, also called a mandrel, on which the packing elements are installed. The port extends through the tubular wall and provides communication from the tubing string inner diameter and the hydraulic cylinder for the packer. There are seals within the cylinder that contain and direct the hydraulic pressure.

One of the disadvantages of hydraulically set mechanical packers is the port in the tubular wall. In pressuring applications, for example, when fracing a well and/or pressurizing the liner, the hydraulic cylinders are subjected to the pressures being utilized and in some cases, empty cyclic pressures, which results in cylinders moving and seals moving under pressure situations, which can be in the range of 10,000 psi and at fairly high elevated temperatures. Under such conditions, the ports in the casing string for setting chambers introduce a point of weakness and potential failure. Additionally, in high temperature applications, seals, and the like, can degrade, and a leak path can form through the port in the mandrel and into the annulus, past the problematic seals.

Accordingly, there remains a need for improvements in the art.

BRIEF SUMMARY OF THE INVENTION

In accordance with a broad aspect of the present invention, there is provided a wellbore packer with a port-less mandrel.

In accordance with another broad aspect, there is provided a method for creating a seal in a wellbore annulus.

According to an embodiment, there is provided a method for installing a packer to create a seal in a wellbore defined by a wellbore wall, the method comprising: running the packer into a wellbore, the packer installed in a tubing string and including a packing element and a setting mechanism for the packing element; positioning the packer in the wellbore adjacent an open hole section of the wellbore wall to create an annular area between the packer and the wellbore wall; setting the packer while isolating tubing string pressure from the packer setting mechanism and while maintaining hydrostatic pressure in the annular area; and allowing the packing element to expand to create a seal in the annular area between the tubing string and the open hole section of the wellbore wall.

According to another embodiment there is provided a wellbore installation in a wellbore comprising: a tubing string including a frac port extending therethrough; a wellbore packer connected into the tubing string and forming an annular seal in the wellbore separating an first annular area accessed through the frac port from a second annular area, the wellbore packer including: a port-less mandrel having a longitudinal axis; a packing element coupled to said mandrel; a setting mechanism coupled to said port-less mandrel including a piston configured with a compressing ring proximate one end of the packing element, and a stop ring proximate another end of said packing element, said stop ring being affixed to said mandrel and configured to block movement of said packing element; the setting mechanism configured to be responsive to a driving force to drive the piston in a first direction along said longitudinal axis to move said compressing ring against said one end of said packing element and compress said packing element against said stop ring so that said packing element is compressed and expands outwardly from said port-less mandrel to form the seal in the wellbore; and a port for communicating fluid from the first annular area to the piston.

According to another embodiment, there is provided a wellbore packer for setting one or more packing elements in a borehole, the wellbore packer comprising: a port-less mandrel having a longitudinal axis; first and second packing elements coupled to the mandrel in a spaced relationship along the longitudinal axis; a first piston configured with a first compressing ring proximate one end of the first packing element, and a first stop ring proximate another end of the first packing element, the first stop ring being affixed to the port-less mandrel and configured to block movement of the first packing element; a second piston configured with a second compressing ring proximate one end of the second element, and a second stop ring proximate another end of the second packing element, the second stop ring being affixed to the port-less mandrel and configured to block movement of the second packing element; a drive mechanism coupled to the port-less mandrel and configured to drive the first piston in a first direction along the longitudinal axis to move the first compressing ring against the one end of the first packing element and compress the first packing element against the first stop ring so that the packing element is compressed and expands outwardly from the port-less mandrel to form a seal in the open hole; and the drive mechanism being configured to drive the second piston in a second direction along the longitudinal axis opposite the first direction and move the second compressing ring against the one end of the second packing element and compress the second packing element against the second stop ring so that the packing element is compressed and expands outwardly from the port-less mandrel to form a seal in the open hole.

It is to be understood that other aspects of the present invention will become readily apparent to those skilled in the art from the following detailed description, wherein various embodiments of the invention are shown and described by way of illustration. As will be realized, the invention is capable for other and different embodiments and its several details are capable of modification in various other respects, all without departing from the spirit and scope of the present invention. Accordingly the drawings and detailed description are to be regarded as illustrative in nature and not as restrictive.

BRIEF DESCRIPTION OF THE DRAWINGS

Referring to the drawings, several aspects of the present invention are illustrated by way of example, and not by way of limitation, in detail in the figures, wherein.

In the drawings, like reference numerals indicate like elements.

DETAILED DESCRIPTION OF THE EMBODIMENTS

Figure 1:
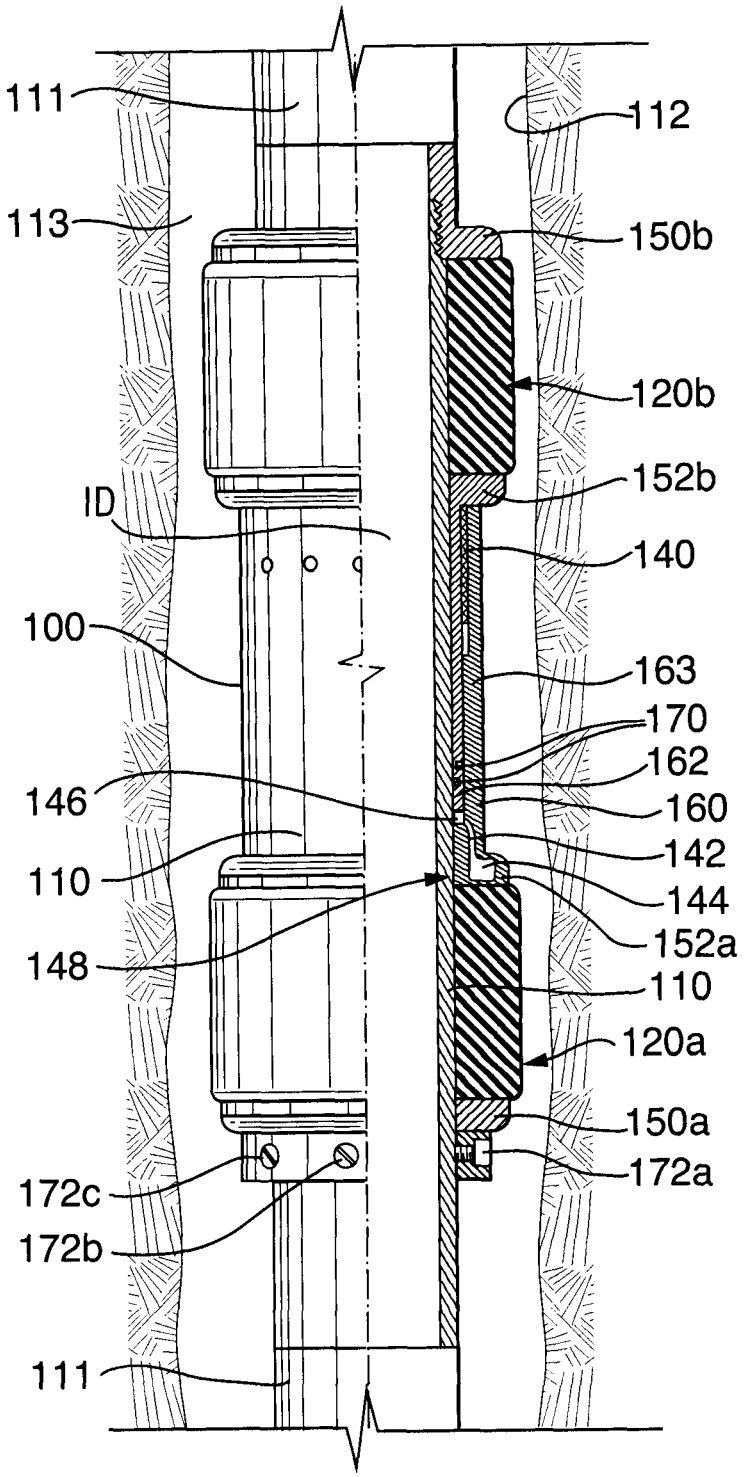
FIG. 1 is a sectional view through a wellbore packer according to an embodiment of the present invention.
Figure 2A:
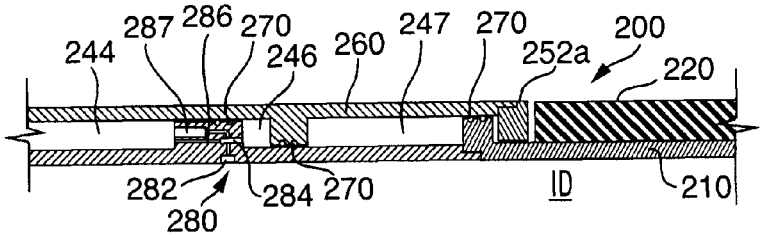
FIGS. 2(*a*) to 2(*f*) illustrate operation of a magnetic switch to set a packer in accordance with an embodiment of the present invention.
Figure 2B:
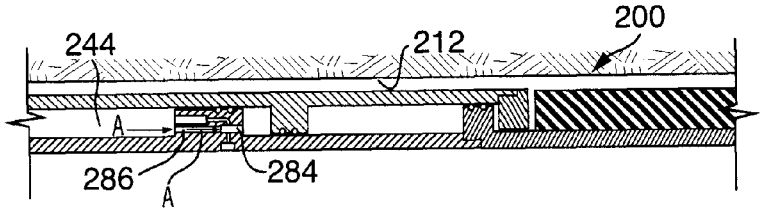
Figure 2C:
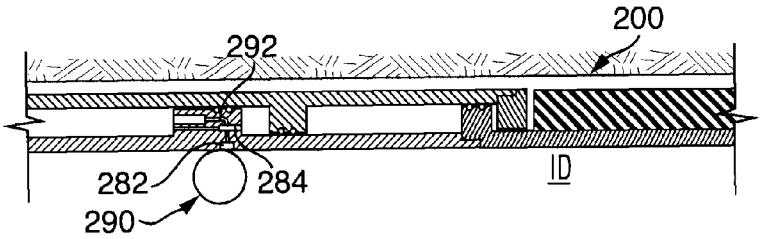
Figure 2D:
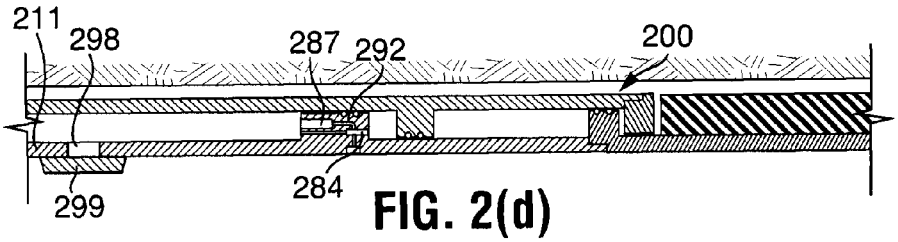
Figure 2E:
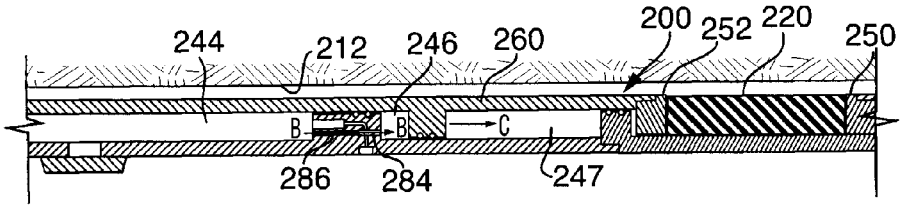
Figure 2F:
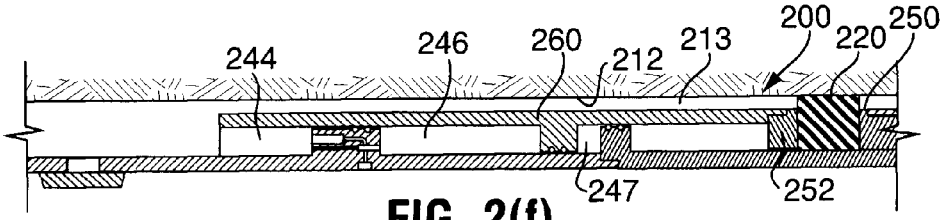

The description that follows, and the embodiments described therein, is provided by way of illustration of an example, or examples, of particular embodiments of the principles of various aspects of the present invention. These examples are provided for the purposes of explanation, and not of limitation, of those principles and of the invention in its various aspects. In the description, similar parts are marked throughout the specification and the drawings with the same respective reference numerals. The drawings are not necessarily to scale and in some instances proportions may have been exaggerated in order more clearly to depict certain features.

The present application discloses a packer that does not require a through-mandrel setting port, i.e. a port or opening through which fluid communicates outwardly from the mandrel inner diameter (ID). According to an embodiment, the packer is set using a hydraulic configuration as described in more detail below. According to one aspect, the packer mandrel comprises a port-less, end-to-end steel liner with all moving parts on the outside of the packer. It will be appreciated that one advantage of not having a port in the mandrel is a possible leak point is avoided. For example, when the liner is pressurized, for example, during fracturing operations or the like, the packer and/or the setting cylinder are not subjected to the pressurization, which decreases the likelihood of a pressure-based breach in the mandrel. As described in more detail below, the hydraulic arrangement provides a mechanism for activating the packer in the down hole without requiring pressurization of the tubing string inner diameter on which the packer is carried and without communication of that inner diameter pressure to the packer. Stated another way, the mechanism for setting the packer may be operated in isolation from tubing string pressure. In one embodiment, for example, the packer may be triggered and driven to set while the normal, natural tubing string pressure for that depth (hydrostatic pressure) is maintained in the tubing string.

The packer also includes a packing element that, when triggered, sets to create a seal in the annulus about the mandrel. When setting, the packing element expands radially outwardly to fill the space between the liner and the wellbore wall, which may be casing in a cased hole or exposed formation in an open hole. The packing element may be set by a setting mechanism that operates by mechanical compression or by swelling.

In an embodiment where the packing element is set by mechanical compression, the compression may be by stroking of a setting mechanism. Stroking of the setting mechanism applies a force against the packing element such that it is axially compressed and it extrudes outwardly. Where the packing element is set by swelling, a setting mechanism, for example, one that strokes, may expose the swellable element to fluid that causes it to expand. In one embodiment, the swellable element is normally isolated, as by a covering, from a hydraulic fluid that causes swelling and when the packer is triggered, it is stroked to expose the swellable element to that hydraulic fluid so that swelling begins.

The setting mechanism is responsive to a driver. For example, stroking of a setting mechanism could be by any of various drivers including fluid pressure drives, electrical drives, biasing members, etc. Fluid pressure drives may be due to any of various pressurizing events such as (i) by total wellbore pressure, which is the normal annular pressure for a well depth (hydrostatic), (ii) by increasing pressure in the annulus, (iii) by release of pressurized fluid such as from a nitrogen charge, (iv) by a fluid producing event (primer cord), etc. Electrical drive may be generated by a motor powered by a battery or an electrical conductor.

The packer strokes when activated to do so by a triggering mechanism. The triggering mechanism causes the driver to move the setting mechanism and can include one or more of various mechanisms. Since a packer is intended to create a seal in a wellbore, the triggering mechanism may be selected to be activated when the packer is positioned downhole. As such, the triggering mechanism may be responsive to downhole conditions, to only cause the packer to set when the triggering mechanism arrives downhole, and/or the triggering mechanism may be responsive to a signal initiated from surface to only allow stroking when a signal is communicated from surface and received by the triggering mechanism and/or the triggering mechanism may only cause the packer to set when an appropriate time has lapsed, for example, to only allow the packer to set when time has passed sufficient to ensure that the packer is downhole.

According to one embodiment, for example, the packer may include a driver including an atmospheric hydraulic chamber and a hydraulic chamber can be exposed to a pressure drive to act against the atmospheric chamber, a triggering mechanism that is activated to expose the hydraulic pressure chamber to the pressure drive and a setting mechanism in the form of a stroking mechanism, which is configurable to released and driven by the driver, when the triggering mechanism is activated to set the packing element. The stroking mechanism can be part of a hydraulic cylinder that acts against the atmospheric chamber, as driven by the pressure drive and, when activated, can compress the packing element conventionally like a mechanically activated packer. In such an embodiment, the packing element, setting mechanism and driver may be installed on the outside of the mandrel.

Reference is first made to FIG. 1, which shows a wellbore packer according to one embodiment and indicated generally by reference 100. The wellbore packer 100 comprises a mandrel 110, one or more packing elements 120 (indicated individually by references 120*a* and 120*b* in FIG. 1), a hydraulically driven setting mechanism 130 and a mechanical body lock 140, mounted or configured on the mandrel 110.

In use, the mandrel 110 is connected at its ends into a tubing string 111 and positioned in a borehole. According to an embodiment, the borehole comprises an open hole such that at least wellbore wall 112 adjacent the packer is open hole, uncased, with the formation exposed. An annulus 113 is formed between the packer and the wall.

The mandrel 110 comprises a tubular wall defining therein an inner diameter ID. According to an embodiment, the mandrel 110 comprises a port-less configuration, i.e. the mandrel does not include a port in communication with the inner diameter for providing a pressurization path to the packer. Wellbore packer 100 is set using a driver other than tubing string inner diameter ID pressure. As will be described in more detail below, wellbore packer 100 is set using a pressurized fluid, but without the requirement for pressure communication from the inner diameter ID through the mandrel 110 to the packing elements.

The packing elements 120 comprise extrudable packing elements. According to an exemplary implementation, the packing elements 120 are annular and formed of an elastomer, for example, rubber. According to another aspect, the packing elements 120 comprise an enlarged cross section in the set position (for example, as depicted in FIG. 2(*f*)) and the increased expansion ratio allows the packing elements 120 to be set in oversized holes.

As shown in FIG. 1, the packing element 120*a* is mounted between a fixed stop ring 150*a* and a compressing ring 152*a*. Similarly, the second packing element 120*b* is mounted on the mandrel 110 between a fixed stop ring 150*b* and a compressing ring 152*b*. According to an exemplary implementation, the hydraulically actuated setting mechanism 130 comprises a port 142 which provides fluid access from a nitrogen charge 144 to a hydraulic chamber 146 which is defined between a first piston 160 and a second piston 162. The hydraulically actuated setting mechanism 130 is configured with a triggering mechanism indicated generally by reference 148. In operation, the nitrogen charge 144 comprises nitrogen under pressure which is released in response to activation by the triggering mechanism 148 to create a pressure drive.

In operation, actuation of the triggering mechanism 148 results in a release of nitrogen from the nitrogen charge 144 which generates fluid pressure in chamber 146, which drives the first piston 160 against the first compressing ring 152*a* and compresses the first packing element 120*a* against the first fixed stop ring 150*a*. The compression of the packing element 120*a* causes outward expansion. Similarly, actuation of the triggering mechanism 148 drives the second piston 162 against the second compressing ring 152*b* and compresses the second packing element 120*b* against the second fixed stop ring 150*b*. The compression of the packing element 120*b* causes outward expansion to create a seal in the wellbore.

According to an embodiment, the first piston 160 includes a skirt 163, which encloses the hydraulic chamber between the two pistons 160 and 162 and is configured to telescopically ride over the second piston 162. According to another aspect, the wellbore packer 100 includes seals 170 which are configured to prevent leakage of fluid between the piston assemblies.

According to an embodiment, the mechanical body lock system 140 comprises a ratchet mechanism as shown in FIG. 1. The ratchet mechanism 140 is configured between the skirt 163 of the first piston 160 and the second piston 162 and permits the pistons 160, 162 to move away from each other, i.e. in response to fluid pressure of the released nitrogen charge resulting in the compression of the respective packing elements 120, but prevents the pistons 160, 162 from moving back towards each other, i.e. back into the initial positions. According to an exemplary implementation, each of the pistons 160, 162 includes a reciprocal ratchet or latch that engage in the ratchet mechanism 140 to prevent reverse movement of the pistons. By preventing reverse movement of the pistons 160, 162, the ratchet mechanism 140 effectively locks the packing elements 120*a*, 120*b* into a compressed, expanded configuration.

As shown in FIG. 1, the fixed stop ring 150 can include shears indicated generally by reference 180. The shears 172 (indicated individually by references 172*a*, 172*b*, 172*c*, . . . ) are configured to mount or affix the fixed stop ring 150 to the mandrel 110. According to another aspect, the shears 172 are configured to shear or break, for example, when the tubing string is pulled up, this releases the fixed stop ring 150 which in turn releases the compressive force on the packing elements 120.

Triggering mechanism 148 that causes setting mechanism 130 to stroke can include one or more of various mechanisms. For example, while the triggering mechanism may be selected to allow the packer to stroke only when the packer is positioned downhole, the triggering mechanism (i) may be responsive to downhole conditions, to only set when it arrives downhole, and/or (ii) may be timed to set only when a particular time has passed, that time being sufficient to ensure that the packer is downhole and/or (iii) may be responsive to a signal initiated from surface to only allow stroking when the signal is communicated from surface.

As an example of a triggering mechanism activated by signaling from surface, one embodiment employs a stroking mechanism triggered by pressuring up the annulus. For example, the stroking mechanism may be secured by a shear that can be overcome at a particular pressure. The particular pressure may be, for example, above hydrostatic conditions (so the packer is not driven to set by simply running into the hole) but below fracing pressures, such that the formation is not broken down (i.e. fraced) by setting the packer. In particular, normally when a packer is run there is fluid or drilling mud in the hole, the weight of which is known. Therefore it is possible to calculate the height or static pressure of the mud or fluid column in the annulus. This pressure is determined by how much height or static pressure is required to maintain control of the well, including control of the pressure of the gas or hydrocarbons in the well. A packer installed in a well can be run that has a pressure activated setting cylinder set to activate at a particular pressure, which is higher than the pressure generated by the height or static pressure of the mud. Therefore, as the packers are running the well and after they are positioned, they remain in the unset position. However, when the packers are properly positioned and it is appropriate to set them, pressure is applied through the annulus up to fracturing pressure, which may be several thousand PSI higher than the mud weight. So the setting cylinder can be set to trigger and stroke at a pressure somewhere between the hydrostatic pressure of the mud, and the fracturing pressure of the formation.

Once the packers are in the correct position in the well, the particular pressure may be achieved by "pressuring up" the annulus, as by adjustment from surface. In particular, pressure could be applied to the annulus between the tubing string and the wellbore wall in communication with the packer.

In such an embodiment, the increased annular pressure may be employed as the triggering mechanism, but may also be employed as the driver. For example, the annular fluid may be communicated to a piston and a pressure differential could be generated against an atmospheric chamber in the stroking mechanism to drive compression of the packing element. Alternately, the pressuring up can simply trigger the packer operation, for example, permit operation of the setting mechanism and, thereafter, the pressure can be dissipated before a driver, such as hydrostatic pressure, is employed to actually stroke the packer.

To avoid problems of premature setting or problems of pressure isolation (caused by setting of some packers uphole before other packers downhole can receive an annular fluid conveyed signal to set), a delay setting mechanism may be employed to delay stroking for a period after it is triggered. A delay, for example, may be useful in a string where a plurality of packers are to be set by pressuring up the annulus. The delay may allow all packers to reach full setting pressure (for example, just below fracturing pressure), prior to the packers actually setting. Such a system can include a triggering device, a setting mechanism responsive to a driver and a delay mechanism to allow the packer to be triggered but actually delay the final setting of the packer.

A mechanism to delay the setting of packers can be configured to act after triggering to resist movement of the packer setting mechanism to its fully set position until after a selected time has lapsed. That selected time is longer than the setting mechanism would take to move to the set position if the delay mechanism was not employed.

For example, in a packer where the packer setting mechanism is actuated to begin the setting process by a pressure responsive triggering mechanism, the delay mechanism may be configured to act after actuation by a pressure trigger to delay final setting of the packers, until after a selected time has lapsed. In one embodiment, the delay mechanism may include a hydraulic chamber that meters movement of the hydraulic fluid therein to gradually allow a release of a hydraulic fluid. For example, while the setting cylinder can move toward the open position, it is slowed in that movement by the resistance exerted by a delay metering hydraulic chamber between a moveable part of the closure and another fixed part of the closure system. For example, the moveable part may carry a valved piston that moves through the hydraulic chamber as the closure is opened. The valved piston slows movement of the moveable part corresponding to the rate at which the hydraulic fluid in the chamber may pass through the valve's fluid orifice. According to one embodiment, the delay mechanism is adjustable to control the degree of resistance imparted thereby. For example in an embodiment, employing a hydraulic chamber, the viscosity of the hydraulic fluid and/or the size of the valve orifice can be selected, to control the metering effect of the mechanism.

The delay system may work with a driver that provides the energy to move the closure to the open position, after it is actuated. The driver may include one or more of a motor, a biasing member such as a spring or a pressure charge (i.e. a nitrogen chamber charge or an atmospheric pressure chamber), differential pressures, etc. While the driver may be capable of applying a force to rapidly move the setting cylinder, the delay mechanism resists and therefore slows such movement. A driver may permit the setting cylinder to be moved without maintaining the original pressure drive that initiated the movement. For example, if the trigger is by pressuring up the annulus, the pressure may be dissipated but the driver continues to apply a driving force to the setting cylinder. In one embodiment, the driver is selected to operate apart from the trigger. For example, the driver may be a biasing member that generates or stores energy that can only be dissipated after cylinder is actuated to begin opening.

The above-noted reference to use of a delay device is with respect to a pressure driven trigger. However, it is to be understood that the delay device may operate with other triggers, such as those employing signaling apart from annular pressure signaling, as described in greater detail herein below.

While annular pressure drive may be convenient, the porosity of some formations may render it difficult to reliably pressure up the annulus. As such, stroking triggers may include other mechanisms that can be operated while hydrostatic pressure remains unmodified such that the packer can be effectively triggered even in boreholes containing open hole sections where it may be advisable to avoid annular pressuring up.

In particular, signals other than pressuring up the annulus could be initiated from surface, such as those employing sound frequency, a radio signal, a pressure pulse, a vibrational shock wave, etc., that are sensed by the triggering mechanism and cause the driver to stroke the packer. The signals could be conveyed through the annulus or through the tubing string.

A pressure pulse could be communicated through the string inner diameter to be sensed by a strain gauge of the triggering mechanism. The strain gauge senses the slight mandrel expansion generated by the pressure pulse. Alternately, the triggering mechanism may include a pressure sensitive button in the inner diameter of the mandrel that is responsive to the pressure pulse and communicates to the triggering mechanism. Of course, any port through the mandrel should be avoided.

A sound/vibration shock wave, sometimes termed a ping, may be generated from surface or as a result of a surface signal that communicates through the material of the string to a sensor of the triggering mechanism. For example, a shock wave can be generated by a mechanical strike applied to the liner at surface.

According to another embodiment, the triggering mechanism comprises a temperature responsive mechanism. For example, the triggering mechanism exhibits a different thermal contraction and expansion characteristic, so that when the tool assembly heats up, it expands to catch the trigger mechanism, and once it cools back down, the packer activates the external port and allows the atmospheric over hydraulic chamber to stroke and pack off the packing elements. The temperature fluctuations can be driven from surface to drive the thermal cycling of the temperature responsive mechanisms. One possible embodiment operates in response to a temperature change in the well bore to allow the driver, such as a mechanism configured to act against an atmospheric chamber to set the packing element. For example, an expandable piece of metal could be built into the cylinder and the expandable piece of metal would expand or contract under temperature applications. In one embodiment, the metal piece could expand and it would lengthen along with the rest of the packer but when cooled down, it would contract more than the other components to thereby set the packer. For example, all packer components may expand approximately the same distance or coefficient as the system heats up when run down hole but when cool down begins, the mechanism sets up the packer. In normal wellbore operations, wellbore temperatures of 100 degrees F. or to 150 degrees F. are typically encountered, and some sites can reach around 300 degrees F. Once the liner is in place, the system could be treated to a cool down operation. Cool down of the liner may be achieved during pumping operations, such as during a circulating operation or while fracing the well. In either case, after all the parts including the packer, the mandrel and the expandable metal piece are heated, cooling can set the packer, such as by shift the stroking cylinder to the open position.

Yet another embodiment employs a timer which can be set to trigger the packer at a particular time to stroke and expand the packing elements. For example, an electronic timer is configured to trigger the packer to stroke. For example, based on the expected time for installation of the string, a time may be selected (i.e. 24 to 48 hours after the system is installed) after which the mechanism activates the cylinder to stroke. The timer may be turned on before running the packer system in the ground.

In another embodiment, the trigger may be responsive to an activating tool, such a drop bar or plug, such as a ball or dart, passed through the mandrel of the packer. The tool may emit a signal picked up by the triggering mechanism such as for example a radio frequency signal emitter, an RF ID tag, or the like which would be carried on a pump down or dropped tool and a radio frequency sensor would sense the tag and communicate to other components of the triggering mechanism which in turn cause the driver to stroke and expand the packer. For example, the sensor may activate electronics of the triggering mechanism which in turn would open a port or detonate a charge or to allow a hydraulic cylinder to stroke and expand the packer. Such a system may require a battery pack to power the sensor and electronics.

For example, reference is next made to FIGS. 2(*a*) to 2(*f*), which show another embodiment of a wellbore packer. This packer has a driver based on annular pressure and a triggering mechanism responsive to a signal communicated from surface, which in this embodiment is a signal communicated via a tool conveyed through the tubing string to the packer.

The wellbore packer is indicated generally by reference 200 and includes a packing element 220 on a mandrel 210, a hydraulic chamber 246 openable via a conduit 286 to a chamber 244 open to annular pressure, an atmospheric chamber 247, a piston 260, a fixed stop ring 250, a compressing ring 252 and seals 270.

The wellbore packer further includes a magnetic activation mechanism, i.e. triggering mechanism, indicated generally by reference 280 and comprising a magnetic switch 282. The magnetic switch 282 is operatively coupled to a hole opener 284, such as a valve, which is operatively coupled to conduit 286 between the chamber 244 and chamber 246. As shown, the magnetic activation mechanism 280 also includes a battery 287. The hole opener 284 in a closed position prevents the fluid pressure from being communicated from chamber 244 to chamber 246, as indicated by arrow A in FIG. 2(*b*). In response to actuation by the magnetic switch 282, the hole opener 284 moves to an open position and allows fluid to flow from the chamber 244 and into chamber 246 as indicated by arrow B in FIG. 2(*e*). According to an embodiment, the battery 287 is operatively coupled to the hole opener 284 and energizes the hole opener 284 to reconfigure from the closed position to the open position. The pressurized fluid pressurizes the chamber 246 and creates a pressure differential against atmospheric chamber 247 to move the piston 260 in the direction of arrow C (FIG. 2(*e*)) which moves the compressing ring 252 against the packing element 220 and compresses the packing element against the fixed stop ring 250, as shown in FIG. 2(*f*). In this position, the packing element 220 is expanded outwardly to fill the annulus and seal against the wall 212 of the wellbore. Slips (not shown) may also be driven outwardly by this compressive force.

The magnetic switch 282 is activated by exposure to a magnetic field. According to an embodiment, a tool is passed through the mandrel configured with a magnetic component that emits a magnetic field and activates the magnetic switch 282 when moved in the proximity of the switch 282. According to another embodiment, a ball or dart indicated generally by reference 290 in FIG. 2(*c*) is configured with a magnetic component capable of activating the magnetic switch 282. The dart 290 is brought, by dropping, pumping, etc. through the tubing string inner diameter ID, into proximity with the magnetic switch 282 and magnetic switch 282 is actuated by the magnetic field emitted from the dart 290. Then, as described above, the magnetic switch 282 actuates the hole opener 284, the chamber 246 is pressurized by fluid from the annulus and the piston 260 is driven in the direction of arrow C (FIG. 2(*e*)) to compress and outwardly expand the packing element 220 (i.e. "set" the packing element 220) as illustrated in FIG. 2(*f*).

In one embodiment, hole opener 284 may operate in response to power being applied thereto. For example, when the magnetic field is applied to switch 282, the switch completes a circuit, for example, through contacts that become closed such that power can be provided from battery 287 to hole opener 284, to cause the hole opener to open.

As noted above, the packer setting operation may include a delay mechanism wherein there is a delay between the packer being triggered and the packer actually setting. In the illustrated embodiment of FIG. 2, for example, a delay mechanism such as timer 292 (FIG. 2(*d*)) may operate delay operation of hole opener 284 to open fluid communication to chamber 246 for a period of time after plug 290 actually activated switch 282.

The above-noted packer is an example of a packer that can be set employing hydrostatic pressure, since the atmospheric chamber is isolated and can be selected to be less than hydrostatic. Thus the packer is useful in open hole conditions such as where the porosity of the formation may render it difficult to reliably pressure up the annulus.

A packer as disclosed may be initially set by annular pressure, but may have its setting force increased when frac pressures are applied, for example through a frac port 298 off set axially along the tubing string in which the packer is installed. While frac port 298 is normally closed by a closure such as sleeve 299, it can be opened, for example after setting the packer, to permit tubing string pressure to be communicated into the annular area 213. For example, the packers disclosed herein may be useful in frac operations wherein after the packer is set (FIG. 2(*f*)) to create a seal and isolate annular area 213 from an annular area on the other side of the packing element, a pressure well above hydrostatic may be introduced to the annulus 213 between the packer and wellbore bore wall with the intention to frac, and therefore break down, the formation at wall 212. By placing the pressure communication port, in this case conduit 286 in a position where frac pressure is communicated to it from annulus 213, pressures much greater than annular hydrostatic, which was used to set the packer, is communicated to chamber 246 and will act against chamber 260 to further compress packing element 220. As such, when annulus 213 is fraced, the packer's setting force will be increased.

Frac pressure can only be employed to increase the setting pressure if the packer has a piston exposed to frac pressure. For example, in an embodiment such as that of FIG. 1, packing elements 120*a*, 120*b*, when set create a pressure isolated wellbore area therebetween to which frac pressure will not be communicated. If it was desired to provide the packer of FIG. 1 with a setting mechanism responsive after initial setting to frac pressure, a pressure responsive piston open to annular pressure could be provided adjacent ring 150*a* and/or ring 150*b*.

It will be appreciated that according to the port-less or no-port configuration as described above, the packer setting is initiated through application of external energy supplied by any of various drivers and a triggering mechanism, to cause setting of the packer when required. Then once the trigger is activated, the driver energy is communicated to the stroking system which then in turn mechanically sets the packer. As described above, a number of triggering mechanisms can be utilized as described above, including thermal couplings, electronics, a timing mechanism, a radio frequency mechanism, etc.

In a method, the packer including its packing components (elements, driver, etc.) and a no-port or port-less mandrel, is installed in a tubing string, the string is run into a borehole to a selected position in the borehole, the packer is triggered (i.e. as described above) to be driven to expand and seal against the borehole wall to create a seal in an annulus between the string and the borehole wall. Some consideration may be given to borehole conditions when selecting the triggering mechanism. According to an exemplary application, the borehole comprises an open hole section, and the triggering mechanism selected is mechanism suitable for an open hole application, i.e. a triggering mechanism that is not operate in response to conditions that would hinder the formation exposed in an open hole wellbore. According to another aspect, after initial setting, frac pressure is communicated to a setting mechanism to increase the setting force for the packer.

The previous description of the disclosed embodiments is provided to enable any person skilled in the art to make or use the present invention. Various modifications to those embodiments will be readily apparent to those skilled in the art, and the generic principles defined herein may be applied to other embodiments without departing from the spirit or scope of the invention. Thus, the present invention is not intended to be limited to the embodiments shown herein, but is to be accorded the full scope consistent with the claims, wherein reference to an element in the singular, such as by use of the article "a" or "an" is not intended to mean "one and only one" unless specifically so stated, but rather "one or more". All structural and functional equivalents to the elements of the various embodiments described throughout the disclosure that are know or later come to be known to those of ordinary skill in the art are intended to be encompassed by the elements of the claims. Moreover, nothing disclosed herein is intended to be dedicated to the public regardless of whether such disclosure is explicitly recited in the claims. No claim element is to be construed under the provisions of 35 USC 112, sixth paragraph, unless the element is expressly recited using the phrase "means for" or "step for".

What is claimed is:

1. A wellbore installation in a wellbore comprising:

a tubing string including a frac port;

a wellbore packer connected into the tubing string and forming an annular seal in the wellbore separating an first annular area accessed through the frac port from a second annular area, the wellbore packer including:

a port-less mandrel having a longitudinal axis;

a packing element coupled to said mandrel;

a setting mechanism coupled to said port-less mandrel including a piston configured with a compressing ring proximate one end of the packing element, and a stop ring proximate another end of said packing element, said stop ring being affixed to said mandrel and configured to block movement of said packing element; the setting mechanism configured to be responsive to a driving force to drive the piston in a first direction along said longitudinal axis to move said compressing ring against said one end of said packing element and compress said packing element against said stop ring so that said packing element is compressed and expands outwardly from said port-less mandrel to form the seal in the wellbore; and a port for communicating fluid from the first annular area to the piston.

2. A wellbore packer for creating a seal in a borehole, said wellbore packer comprising:

a port-less mandrel having a longitudinal axis;

first and second packing elements coupled to said mandrel in a spaced relationship along said longitudinal axis;

a first piston configured with a first compressing ring proximate one end of said first packing element, and a first stop ring proximate another end of said first packing element, said first stop ring being affixed to said mandrel and configured to block movement of said first packing element;

a second piston configured with a second compressing ring proximate one end of said second element, and a second stop ring proximate another end of said second packing element, said second stop ring being affixed to said mandrel and configured to block movement of said second packing element;

a drive mechanism coupled to said port-less mandrel and configured to drive said first piston in a first direction along said longitudinal axis to move said first compressing ring against said one end of said first packing element and compress said first packing element against said first stop ring so that said packing element is compressed and expands outwardly from said mandrel to form a seal in the borehole; and said drive mechanism being configured to drive said second piston in a second direction along said longitudinal axis opposite said first direction and move said second compressing ring against said one end of said second packing element and compress said second packing element against said second stop ring so that said packing element is compressed and expands outwardly from said mandrel to form a seal in the borehole.

3. The wellbore packer as claimed in claim 2, further including a locking mechanism comprising a locking ratchet, said first piston being configured with a reciprocal ratchet for engaging said locking ratchet, said second piston being configured with a reciprocal ratchet for engaging said locking ratchet, and said locking ratchet being configured to prevent bi-directional movement of said first and said second pistons.

4. The wellbore packer as claimed in claim 2, wherein said first piston comprises a piston skirt and said second piston comprises a piston skirt having an exterior surface, and the piston skirt of said first piston is positioned around the exterior surface of the piston skirt of said second piston and configured in an overlapping and telescoping arrangement.

5. The wellbore packer as claimed in claim 2, wherein the borehole comprises an open hole section, and said wellbore packer is positioned to set the packing elements in said open hole section.

* * * * *